US011933296B2

(12) United States Patent
McBrien

(10) Patent No.: US 11,933,296 B2
(45) Date of Patent: Mar. 19, 2024

(54) ORBITAL PUMP

(71) Applicant: Edwards Limited, Burgess Hill (GB)

(72) Inventor: Peter Anthony McBrien, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 122 days.

(21) Appl. No.: 17/428,195

(22) PCT Filed: Feb. 18, 2020

(86) PCT No.: PCT/GB2020/050379
§ 371 (c)(1),
(2) Date: Aug. 3, 2021

(87) PCT Pub. No.: WO2020/169958
PCT Pub. Date: Aug. 27, 2020

(65) Prior Publication Data

US 2022/0120274 A1 Apr. 21, 2022

(30) Foreign Application Priority Data

Feb. 18, 2019 (GB) ..... 1902223

(51) Int. Cl.
*F04C 18/02* (2006.01)
*F04C 28/28* (2006.01)

(52) U.S. Cl.
CPC ..... *F04C 18/0215* (2013.01); *F04C 28/28* (2013.01); *F04C 2270/70* (2013.01)

(58) Field of Classification Search
CPC .. F04C 18/0215; F04C 2270/70; F04C 28/28; F04C 29/0057; F04C 14/28; F04C 2/025;
(Continued)

(56) References Cited

U.S. PATENT DOCUMENTS 5,462,418 A 10/1995 Shimuzu et al.
9,297,384 B2 3/2016 Stones et al.
(Continued)

FOREIGN PATENT DOCUMENTS

CN 101072949 A 11/2007
CN 103732922 A 4/2014
(Continued)

OTHER PUBLICATIONS

Search Report from counterpart Chinese Application No. 202080015160.7 dated Jul. 22, 2022, 3 pp.
(Continued)

*Primary Examiner* — Anthony Ayala Delgado
(74) *Attorney, Agent, or Firm* — Shumaker & Sieffert, P.A.

(57) ABSTRACT

A safety device for an orbital pump has first and second interleaved parts which are operable to follow an orbital path with respect to each other, the safety device comprising: a first member fixable with respect to the first interleaved part; and a second member fixable with respect to the second interleaved part, the second member defining an aperture into which the first member is receivable, the aperture being dimensioned to prevent movement of the first interleaved part with respect to the second interleaved part beyond the orbital path. In this way, the members of the safety device help to prevent the moving components of the pump contacting, thereby preventing damage.

13 Claims, 2 Drawing Sheets

(58) Field of Classification Search
CPC ..... F04C 2240/10; F04C 2240/20; F04C 2240/81
See application file for complete search history.

(56) References Cited

U.S. PATENT DOCUMENTS

| | | | | |
|---|---|---|---|---|
| 2008/0124236 | A1 | 5/2008 | Schofield | |
| 2009/0028736 | A1* | 1/2009 | Theodore, Jr. ..... | F04C 18/0215 417/410.5 |
| 2010/0172781 | A1 | 7/2010 | Kuwahara et al. | |
| 2014/0271305 | A1 | 9/2014 | Forni | |
| 2023/0185542 | A1* | 6/2023 | Ghosh ..... | G06F 8/316 717/107 |

FOREIGN PATENT DOCUMENTS

| | | | | |
|---|---|---|---|---|
| CN | 204041464 | U | * | 12/2014 |
| CN | 107076144 | A | | 8/2017 |
| JP | 200930607 | A | | 2/2009 |
| JP | 2014177934 | A | | 9/2014 |
| WO | 2016067206 | A1 | | 5/2016 |

OTHER PUBLICATIONS

Combined Search and Examination Report under Sections 17 and 18(3) dated Aug. 19, 2019 from counterpart GB Application No. 1902223.5, 6 pp.
International Search Report and Written Opinion dated Apr. 8, 2020 from counterpart International Application No. PCT/GB2020/050379, 10 pp.
Decision of Rejection and translation thereof, from counterppart Japanese Application No. 2021-547858 dated Dec. 21, 2023, 9 pp.

* cited by examiner

ORBITAL PUMP

This application is a national stage entry under 35 U.S.C. § 371 of International Application No. PCT/GB2020/050379, filed Feb. 18, 2020, which claims the benefit of GB Application No. 1902223.5, filed Feb. 18, 2019, the entire contents of each of which are incorporated herein by reference.

TECHNICAL FIELD

The field of the disclosure relates to orbital pumps or compressors.

BACKGROUND

An orbital pump or compressor is a pump or compressor formed of two interleaving scrolls one of which has an orbital motion with respect to the other thereby trapping and pumping or compressing pockets of fluid between the scrolls. In some cases, one of the scrolls is fixed, while the other is mounted on a drive shaft with an eccentric centre such that it orbits eccentrically without rotating. Another method for producing the relative orbiting motion is by co-rotating the scrolls, in synchronous motion, but with offset axes of rotation. Thus, in this case the two scrolls are mounted on parallel shafts and the relative motion is the same as if one were orbiting and the other stationary.

In the case of fixed and orbiting scrolls an anti-rotation device may be used connected to the scrolls to resist relative rotation between them and thereby allow the radial clearances to be accurately maintained as the scrolls pump. The anti-rotation device should resist rotational movement but also allow the relative orbiting motion required for the pumping. Although such anti-rotation devices exist, they each have their own shortcomings.

SUMMARY

According to a first aspect, there is provided a safety device for an orbital pump having first and second interleaved parts which are operable to follow an orbital path with respect to each other, the safety device comprising: a first member fixable with respect to the first interleaved part; and a second member fixable with respect to the second interleaved part, the second member defining an aperture into which the first member is receivable, the aperture being dimensioned to prevent movement of the first interleaved part with respect to the second interleaved part beyond the orbital path. The aperture is dimensioned to accommodate movement of the first member without contact when following the orbital path. Accordingly, the first member may move freely within the aperture and fail to contact the second member when the interleaved parts are correctly following the orbital path.

The first aspect recognizes that a problem with existing orbital pumps is that components of the orbital pump, such as the anti-rotation device, can fail which can result in contact occurring between the moving parts of the pump which can cause damage. Accordingly, an orbital pump device may be provided. The device may be fitted to an orbital pump which has interleaved parts. The parts may move with respect to each other along a locus or orbital path. The device may comprise a first member or component which may be fixed to move with the first interleaved part. The device may comprise a second member or component which may be fixed to move with the second interleaved part. The second member may provide an aperture or opening. The first member may be received or located in that aperture. The aperture may be shaped and sized to prevent or restrict movement between the interleaved parts which is greater than the orbital path. In this way, the members of the safety device help to prevent the moving components of the pump contacting, thereby preventing damage.

In some examples, the first member is elongate, at least an axial portion of which is receivable within the aperture. Accordingly, part of the length of the first member may be located within the aperture.

In some examples, the first member fixable to the first interleaved part which forms part of a casing of the orbital pump.

In some examples, the first member comprises a rod have a circular cross-section. It will be appreciated that the cross-section could have any shape but that a circular cross-section is particularly suitable.

In some examples, the second member is planar.

In some examples, the second member is a plate.

In some examples, movement of the first interleaved part with respect to the second interleaved part follows the orbital path and the aperture is dimensioned to match the orbital path. Accordingly, the shape of the aperture may be the same as the orbital path.

In some examples, the aperture is dimensioned to contact with the first member when failing to follow the orbital path. Accordingly, when the interleaved parts do not correctly followed the orbital path, contact occurs between the first and second members to prevent additional motion.

In some examples, the aperture is dimensioned to contact with the first member when exceeding the orbital path.

In some examples, the aperture is dimensioned to contact with the first member when exceeding the orbital path plus a tolerance amount.

In some examples, the aperture and the first member are dimensioned to prevent further movement of the first interleaved part with respect to the second interleaved beyond the orbit.

In some examples, at least a part of the first member and the second member is conductive. Accordingly, portions of the first and second members may be electrically conductive.

In some examples, contact between the first member and the second member facilitates transmission of a signal to prevent operation of the orbital pump. Accordingly, a circuit may be completed when the two members contact which causes the motor to be shut down to prevent further damage.

According to a second aspect, there is provided an orbital pump, comprising: first and second interleaved parts which are operable to follow an orbital path with respect to each other; and the safety device of the first aspect and its examples.

According to a third aspect, there is provided a method, comprising: fixing a first member fixed with respect to a first interleaved part of an orbital pump having first and second interleaved parts which are operable to follow an orbital path with respect to each other; fixing a second member fixed with respect to the second interleaved part, the second member defining an aperture into which the first member is receivable; dimensioning the aperture to prevent movement of the first interleaved part with respect to the second interleaved part beyond the orbital path.

In some examples, the first member is elongate, the method comprising receiving at least an axial portion of the first member within the aperture.

In some examples, the method comprises fixing the first member to the first interleaved part which forms part of a casing of the orbital pump.

In some examples, the first member comprises a rod have a circular cross-section.

In some examples, the second member is planar.

In some examples, the second member is a plate.

In some examples, movement of the first interleaved part with respect to the second interleaved part follows the orbital path and the method comprises dimensioning the aperture to match the orbital path.

In some examples, the method comprises dimensioning the aperture to accommodate movement of the first member without contact when following the orbital path.

In some examples, the method comprises dimensioning the aperture is dimensioned to accommodate movement of the first member without contact when following the orbital path plus a tolerance amount.

In some examples, the method comprises dimensioning the aperture to contact with the first member when failing to follow the orbital path.

In some examples, the method comprises dimensioning the aperture to contact with the first member when exceeding the orbital path.

In some examples, the method comprises dimensioning the aperture to contact with the first member when exceeding the orbital path plus a tolerance amount.

In some examples, the method comprises dimensioning the aperture and the first member to prevent further movement of the first interleaved part with respect to the second interleaved beyond the orbit.

In some examples, at least a part of the first member and the second member is conductive.

In some examples, the method comprises transmitting a signal to prevent operation of the orbital pump in response to contact between the first member and the second member.

Where an apparatus feature is described as being operable to provide a function, it will be appreciated that this includes an apparatus feature which provides that function or which is adapted or configured to provide that function.

BRIEF DESCRIPTION OF DRAWINGS

Examples of the present disclosure will now be described further, with reference to the accompanying drawings.

DETAILED DESCRIPTION

Before discussing the examples in any more detail, first an overview will be provided. Examples provide a mechanism which mechanically prevents moving components of an orbital pump or compressor from moving beyond their expected paths, which would otherwise cause the components to contact, causing damage to the pump or compressor. The mechanism has two parts, one of which attaches to one of the components and the other attaches to the other component. One part extends into an opening in the other part. When too much movement occurs, the parts contact each other and mechanically prevent further movement of the components. In addition, the contact between the parts can complete a circuit which cuts power to the pump motor causing it to stop, thereby preventing further damage.

Examples can be applied to both common orbital pump or compressor, such as scroll pump or compressor configurations: Type 1 in which one scroll is stationary and the other orbits, and Type 2 in which both scroll components rotate.

Pump

Figure 1:
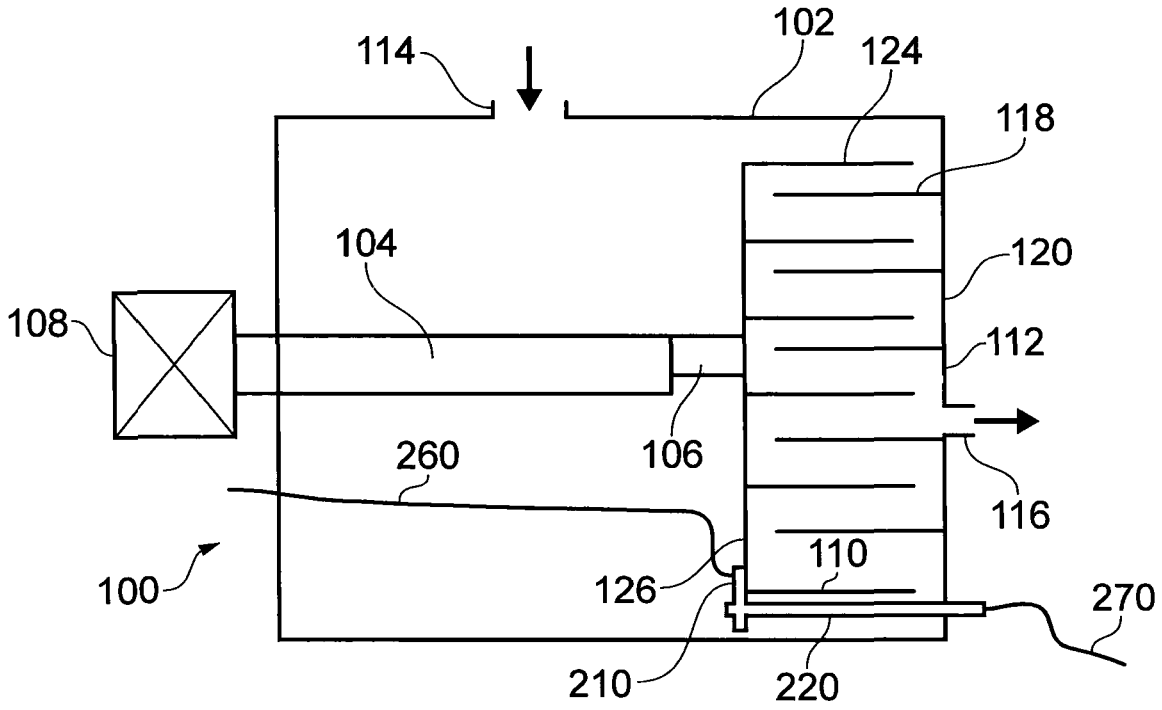
FIG. 1 illustrates an orbital pump or compressor such as scroll pump or compressor according to one example.

FIG. 1 illustrates an orbital pump or compressor such as scroll pump or compressor 100 according to one example. A scroll may be used as a vacuum pump for example for evacuating a process chamber in which semiconductor products are processed. The pump 100 comprises a pump housing 102 and a drive shaft 104 having an eccentric shaft portion 106. The shaft 104 is driven by a motor 108 and the eccentric shaft portion is connected to an orbiting scroll 110 so that during use rotation of the shaft 104 imparts an orbiting motion to the orbiting scroll 110 relative to a fixed scroll 112 for pumping fluid along a fluid flow path between a pump inlet 114 and pump outlet 116 of the pump 100.

The fixed scroll 112 forms part of the pump housing 102 and comprises a scroll wall 118 which extends perpendicularly to a generally circular base plate 120. The orbiting scroll 110 comprises a scroll wall 124 which extends perpendicularly to a generally circular base plate 126. The orbiting scroll wall 124 co-operates, or meshes, with the fixed scroll wall 118 during orbiting movement of the orbiting scroll. Relative orbital movement of the scrolls causes a volume of gas to be trapped between the scrolls and pumped from the inlet 114 to the outlet 116.

As mentioned above, radial clearances need to be accurately maintained since otherwise the two scrolls 110, 112 may contact, causing damage. To restrict the relative movement of the two scrolls 110, 112, a safety device 200 is fitted within the housing 102. The safety device 200 has a plate 210 fitted to the base plate 126 of the orbiting scroll 110 and a rod 220 fitted through the housing 102.

Safety Device

Figure 2:
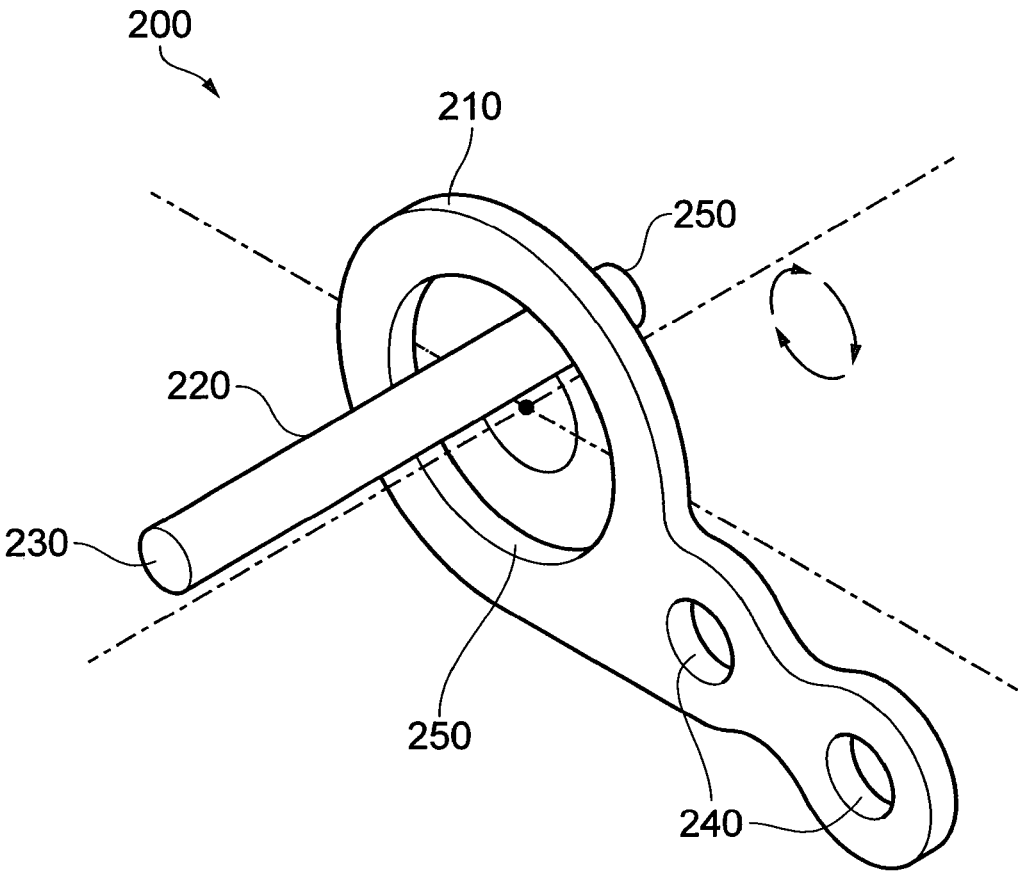
FIG. 2 illustrates a safety device fitted to the pump of FIG. 1 in more detail.

FIG. 2 illustrates the safety device 200 in more detail. The rod 220 has an end 230 which typically extends through the housing 102 and it attached to a fixing (not shown). This secures the rod 220 to the housing 102 and fixes its location spatially with respect to the fixed scroll 112. The rod extends from the housing 102 towards the orbiting scroll 110. The plate 210 has fixings apertures 240 through which fixings (not shown) fix the plate 210 to the base plate 126 of the orbiting scroll 110. This secures the plate 210 to the orbiting scroll 110 such that the plate 210 follows the orbital path of the orbiting scroll 110.

The rod 220 has another end 250 which extends through an orbital aperture formed in the plate 210. The orbital aperture is sized and shaped to match the orbital path followed or relative movement between the fixed scroll 112 and the orbiting scroll 110. That is to say that if a fixed point on one of the scrolls was observed from the other scroll while moving, the locus followed by that fixed point would match the orbital aperture. In this example, the orbital aperture 250 is slightly enlarged to account for manufacturing tolerances of the pump 100. Although in this example, the aperture is generally circular, it will be appreciated that this need not be the case and that the aperture is shaped to match the orbital path.

The rod 220 and the plate 210 are both conductive and connect to wires 260, 270 (one of the wires can be omitted if one of the rod 220 and the plate 210 are connected to the housing 102). The wires 260, 270 couple with a controller (not shown) which controls the operation of the motor 108.

In operation, the motor 108 drives the drive shaft 104 and the orbiting scroll 110 follows an orbital path with respect to the fixed scroll 112. In normal operation, the rod 220 fails to contact the orbital aperture 250 and instead describes a similar path a distance within the orbital aperture 250. Should a fault occur and the orbiting scroll 110 begins to move outside the orbital path by more than the tolerance amount, then the rod 220 will contact the orbital aperture, mechanically preventing further movement outside the orbital path. In addition, contact between the rod 220 and the plate 210 causes a circuit to be made which signals the controller to stop the motor 108 to prevent damage.

Accordingly, one example provides an anti-clash sensor for use on an oscillating or orbiting pump mechanism. Scroll vacuum pumps depend on the radial position of the orbiting scroll being fixed, so that it cannot clash with the adjacent fixed scroll. If there is a failure of the component(s) that fixes the scroll radial position, then a high degree of internal damage can occur with partial or total loss of function. One example performs two functions in order to protect an orbiting pump mechanism from damaging itself in the case of failure: first, it enables an electrical signal to automatically switch off the mechanism; and second, it limits the movement of the oscillating/orbiting part relative to the stationary parts, hence avoiding internal damage. In other words, one example auto protects the pump mechanism when loss of radial position occurs. In particular, one example allows the development of a new scroll pump, preventing damage if an internal failure occurred when testing was unattended (i.e. running overnight and at weekends).

In one example, a probe which is electrically conductive projects through the front cover of a scroll pump, being fixed into an insulating mount (made of PEEK or similar material). A metal sensor ring is attached to the internal orbiting scroll, which in this example uses bolt fixings. The probe is positioned within the internal diameter of the ring, such that the locus of ring relative to the fixed probe allows full orbiting motion of the scroll plus additional radial clearance between the probe and ring. If radial control of the orbiting scroll is lost (the anti-rotation device fails), then the probe will contact the inside diameter of the ring and two things will happen: first, an electrical circuit will be completed between probe and ring; second, excessive rotation of the orbiting scroll is limited, which would otherwise cause catastrophic contact between orbiting and fixed scroll. One example is able to limit the movement of the oscillating/orbiting part relative to the stationary parts, hence avoiding internal damage even when normal control of radial position has failed. This function is combined with the other function—to stop the pump when in the fault condition.

Although illustrative examples of the disclosure have been disclosed in detail herein, with reference to the accompanying drawings, it is understood that the disclosure is not limited to the precise example and that various changes and modifications can be effected therein by one skilled in the art without departing from the scope of the disclosure as defined by the appended claims and their equivalents.

The invention claimed is:

1. A safety device for an orbital pump having first and second interleaved parts which are operable to follow an orbital path with respect to each other, the safety device comprising:

a first member configured to be fixed with respect to the first interleaved part; and a second member configured to be fixed with respect to the second interleaved part, the second member defining an aperture into which the first member is configured to be received, the aperture being dimensioned to prevent movement of the first interleaved part with respect to the second interleaved part beyond the orbital path, wherein the aperture is dimensioned to accommodate movement of the first member without contact when following the orbital path, and wherein contact between the first member and the second member facilitates transmission of a signal to prevent operation of the orbital pump.

2. The safety device of claim 1, wherein the first member is elongate, at least an axial portion of which is configured to be received within the aperture.

3. The safety device of claim 1, wherein the first member configured to be fixed to the first interleaved part which forms part of a casing of said orbital pump.

4. The safety device of claim 1, wherein the first member comprises a rod have a circular cross-section.

5. The safety device of claim 1, wherein the second member is planar.

6. The safety device of claim 1, wherein movement of the first interleaved part with respect to the second interleaved part follows the orbital path and the aperture is dimensioned to match the orbital path.

7. The safety device of claim 1, wherein the aperture is dimensioned to accommodate movement of the first member without contact when following the orbital path plus a tolerance amount.

8. The safety device of claim 1, wherein the aperture is dimensioned to contact with the first member when exceeding the orbital path.

9. The safety device of claim 1, wherein the aperture is dimensioned to contact with the first member when exceeding the orbital path plus a tolerance amount.

10. The safety device of claim 1, wherein the aperture and the first member are dimensioned to prevent further movement of the first interleaved part with respect to the second interleaved part beyond the orbit.

11. The safety device of claim 1, wherein at least a part of the first member and the second member is conductive.

12. An orbital pump, comprising:

first and second interleaved parts which are operable to follow an orbital path with respect to each other; and a safety device comprising:

a first member configured to be fixed with respect to the first interleaved part; and a second member configured to be fixed with respect to the second interleaved part, the second member defining an aperture into which the first member is configured to be received, the aperture being dimensioned to prevent movement of the first interleaved part with respect to the second interleaved part beyond the orbital path, wherein the aperture is dimensioned to accommodate movement of the first member without contact when following the orbital path, and wherein contact between the first member and the second member facilitates transmission of a signal to prevent operation of the orbital pump.

13. A method, comprising:

fixing a first member with respect to a first interleaved part of an orbital pump having the first interleaved part and a second interleaved part, wherein the first and second interleaved parts are operable to follow an orbital path with respect to each other;

fixing a second member with respect to the second interleaved part, the second member defining an aperture into which the first member is configured to be received;

dimensioning the aperture to prevent movement of the first interleaved part with respect to the second interleaved part beyond the orbital path, in response to the first member contacting the second member, transmitting a signal to prevent operation of the orbital pump.

* * * * *